United States Patent [19]

Fuchs

[11] Patent Number: 4,502,272

[45] Date of Patent: Mar. 5, 1985

[54] APPARATUS FOR MAKING A YARN

[75] Inventor: Helmut Fuchs, Linz, Austria

[73] Assignee: Textilmaschinenfabrik Dr. Ernst Fehrer Aktiengesellschaft, Leonding, Austria

[21] Appl. No.: 554,213

[22] Filed: Nov. 22, 1983

[30] Foreign Application Priority Data

Dec. 3, 1982 [AT] Austria ..... 4394/82

[51] Int. Cl.[3] ..... D01H 7/882

[52] U.S. Cl. ..... 57/401; 57/406

[58] Field of Search ..... 57/400, 401, 404, 406, 57/407, 411

[56] References Cited

U.S. PATENT DOCUMENTS

| | | | |
|---|---|---|---|
| 4,091,605 | 5/1978 | Jacobsen | 57/401 |
| 4,202,163 | 5/1980 | Turk et al. | 57/401 |
| 4,281,507 | 8/1981 | Didek et al. | 57/401 |
| 4,334,400 | 6/1982 | Fehrer | 57/401 X |
| 4,399,650 | 8/1983 | Parker et al. | 57/401 |
| 4,420,928 | 12/1983 | Fehrer | 57/401 |

*Primary Examiner*—John Petrakes

*Attorney, Agent, or Firm*—Kurt Kelman

[57] ABSTRACT

Apparatus for making a yarn comprises two juxtaposed, closely spaced apart suction drums, which are rotated in the same sense and each of which contains a suction insert, which is formed with a suction slot that faces the generally triangular space between the two suction drums. To permit the use of a lower suction flow rate and to ensure that this will not adversely affect the quality of the resulting yarn, each suction insert is mounted to be rotatable about the axis of the associated suction drum and positioning drive means are provided, which serve to rotate the suction inserts in mutually opposite senses and comprise two worm wheels, which are secured to respective stub shafts, which protrude axially from the suction drums and are secured to respective ones of the suction inserts, and two worm-carrying shafts, which are in mesh with respective ones of said worm wheels.

2 Claims, 2 Drawing Figures

APPARATUS FOR MAKING A YARN

Figure 1:
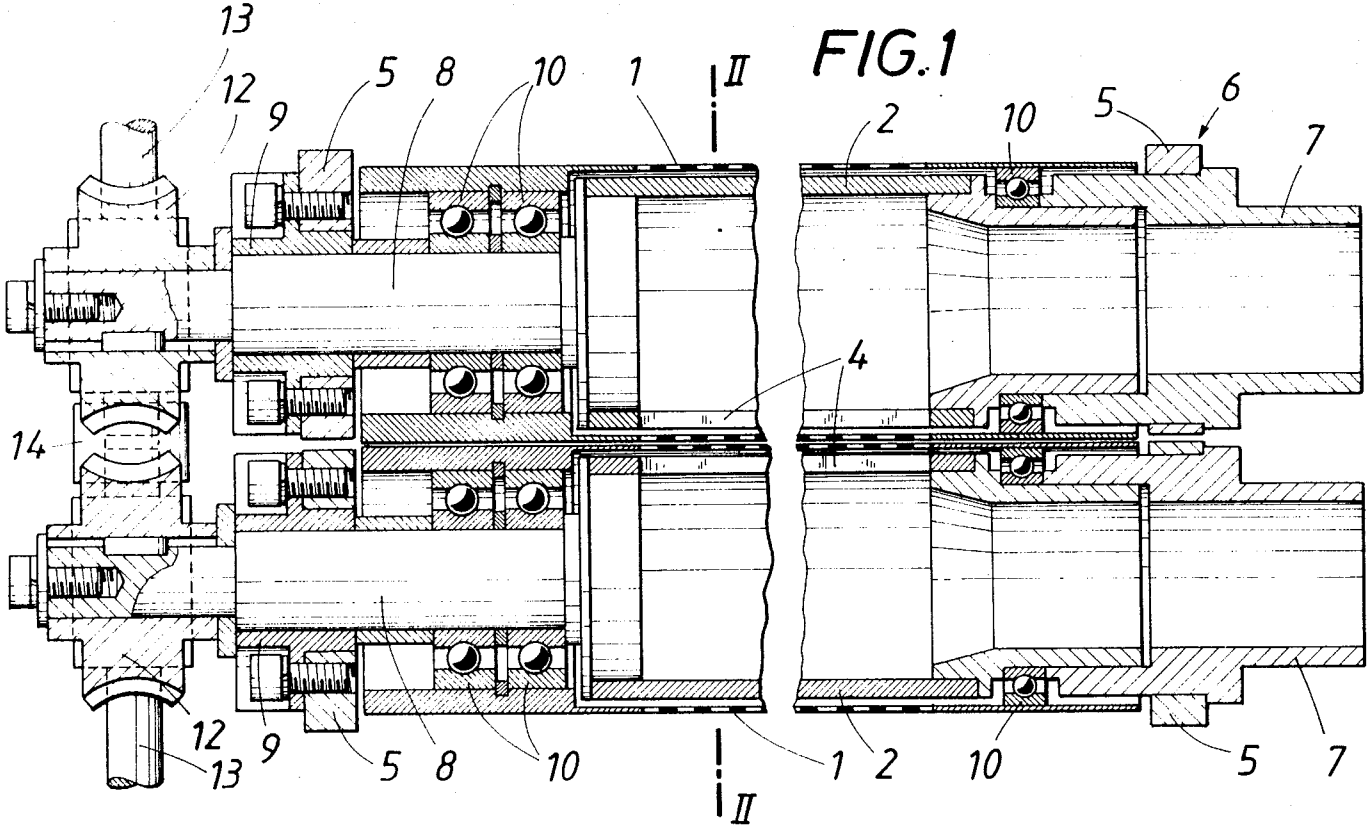

This invention relates to apparatus for making a yarn, comprising two juxtaposed, closely spaced apart suction drums, which are rotated in the same sense and each of which contains a suction insert, which is formed with an at least substantially axially extending suction slot, which faces the generally triangular space between the two suction drums.

In the operation of such apparatus, the suction exerted at the suction slots of the suction inserts results in the formation of suction zones, which are disposed in the region in which the yarn is being formed and which cause the yarn to be urged against both suction drums and to be pulled into the generally triangular space between the suction drums so that regardless of changes in the thickness of the yarn the latter will always snugly contact the surfaces of both suction drums and both drums will exert a twisting torque on the yarn. As the yarn to be made is pulled into the generally triangular space between the two suction drums, the position of the line along which the yarn is being formed will depend on the diameter of the yarn which is made. Thin yarns will be pulled deeply into the nip between the suction drums. Yarns which are larger in diameter will obviously be spaced a larger distance from the nip between the suction drums. For this reason the width of the suction zones must be selected in dependence on the range of diameters of the yarns which are to be made on a given apparatus. If the suction inserts are provided with relatively wide suction slots for making yarns large in diameter, a higher suction flow rate will be required. Because the yarns which differ in diameter have different positions relative to the suction zones, the action of the suction force on the various yarns will differ too and optimum conditions cannot always be ensured.

It is known from U.S. Pat. No. 4,281,507 that in apparatus for twisting individual fibers to form a yarn in a generally triangular space between two drums the drums may be nested rather than juxtaposed. To initiate the twisting of the fibers, the fibers introduced between the drum are moved along a circular path in an inlet portion of the space between the outside surface of the inner drum and the inside surface of the outer drum. This is achieved in that the fibers are urged by centrifugal force against the outer drum, which rotates toward the nip between the drums, and the fibers are only subsequently moved into the region which is subjected to suction from the inner drum, which rotates away from said nip. That suction will then urge the fibers against the inner drum, by which the fibers are then moved out of the triangular space so that they are relieved from the suction force and caused by centrifugal force to fly to the outer drum again. As a result, the fibers are moved in a circular orbit, which is much larger in diameter than the yarn and is centered on an axis that is parallel to the line on which the yarn is being formed, and the yarn is actually formed in a succeeding portion of the space between the drums. The size and position of that circular orbit will depend on the positions of the suction zones. To match that circular orbit to a given yarn to be made, the suction insert of the inner drum and the suction pipe, which may be provided in the outer drum to assist its centrifugal force, can be adjusted in the peripheral direction. But that adjustment of the suction zones will not result in a saving of energy because the diameter of the orbit for the motion of the fibers is so large that relatively large suction slots are required in any case. For this reason that known apparatus cannot make a suggestion how the suction flow rate can be reduced in apparatus having juxtaposed suction drums.

It is an object of this invention to provide apparatus which is of the kind described first hereinbefore and in which the required suction flow rate can be descreased with simple means whereas the range of diameters of the yarns which can be made on such apparatus is not decreased and optimum spinning conditions are ensured in every case.

This object is accomplished in accordance with the invention in that the two suction inserts are mounted for rotation relative to the associated suction drum about the axis of the latter, positioning drive means are provided, which are connected to both suction inserts and operable to rotate the suction inserts in mutually opposite senses, and said positioning drive means comprise two worm wheels, which are secured to respective stub shafts, which protrude axially from the suction drums and are secured to respective ones of the suction inserts, and two worm-carrying shafts, which are in mesh with respective ones of said worm wheels.

Because the positions of the suction slots can be adjusted, the width of the suction slots can be minimized as the positions which may be assumed by the line along which the yarn is being formed need no longer be taken into account in determining the width of the suction slots. By the positioning drive means the two suction inserts can always be adjusted to such positions that the suction zones, which are determined by the suction slots, will includes the line on which the yarn is being formed in the generally triangular space between the suction drums; the position of that line will depend on the diameter on the yarn to be made. As a result, the suction flow rate can be greatly reduced and such reduction will not adversely affect the twisting operation because the action of the suction flow and the point where the suction force is exerted can be exactly controlled.

The suction zones can be adjusted in a simple manner by the positioning drive means, which comprise worm-carrying shafts for adjusting the suction inserts of both suction drums. Because the worm gear train is self-locking, the suction inserts need not be locked by additional means in their adjusted position.

In accordance with the invention the suction inserts are rotatably mounted so that suitable bearings for such mounting are required. To minimize the structural expenditure, the suction inserts may be rotatably mounted in a frame and the suction drums may be rotatably mounted on the suction inserts. The rotatable mounting of the suction drums on the suction inserts will not adversely affect the angular adjustment of the suction inserts because the suction drums must be driven by separate drive means, which may include friction wheels or belts.

Figure 2:
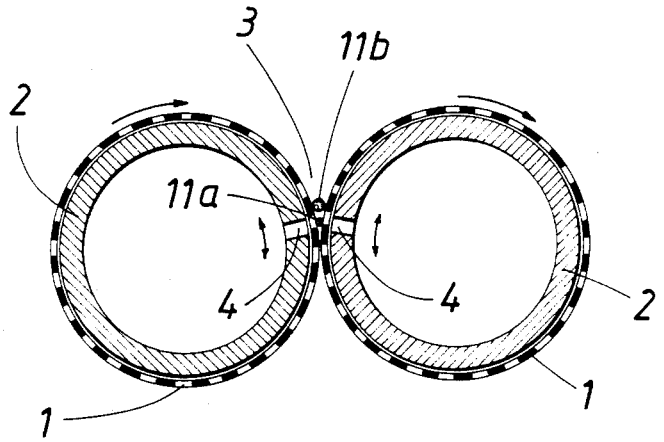

The invention is illustrated by way of example in the drawing, in which:

FIG. 1 is an axial sectional view taken on a plane extending through the two suction drums of yarn-making apparatus embodying the invention and FIG. 2 is a sectional view taken on line II—II in FIG. 1.

The apparatus which is shown in the drawing comprises two air-permeable, juxtaposed suction drums 1, which are closely spaced apart and are rotated in the same sense. Each suction drum 1 contains a suction insert 2, which has an axially extending suction slot 4, which faces the generally triangular space 3 between the two suction drums. The two suction inserts 2 are rotatably mounted in carrying plates 5 of a frame 6. Specifically, each suction insert 2 is rotatably mounted at one end on a fitting 7, which is secured to an associated carrying plate 5 and adapted to be connected to a suction conduit, and each suction insert is secured at its other end to a stub shaft 8, which is rotatably mounted in a sliding surface bearing bushing 9, which is bolted to the second carrying plate 5 associated with the suction insert. Each suction drum 1 is rotatably mounted by bearings 10 on an associated suction insert 2, which is rotatably by the means described hereinbefore. The suction drums 1 are driven to rotate in the same sense by a belt or friction wheel drive, which is not shown for the sake of clearness.

To permit the use of suction slots 4 having a relatively small width whereas this should not involve a great restriction of the range of diameters of the yarns which can be made on such apparatus, the suction inserts 2 can be angularly adjusted so that the suction slots 4 will be close to the line on which a given yarn is being formed. The distance of that line from the plane which contains the axes of both suction drums will depend on the diameter of the yarn that is to be made. These relations are clearly apparent from FIG. 2, in which two yarns differing in diameter are designated 11*a* and 11*b*, respectively.

The means for imparting an angular adjusting movement to the suction inserts 2 comprise worm wheels 12, each of which is secured to one of the stub shafts 8, which axially protrude from respective suction drums 1, and two worms 13, which are in mesh with respective ones of the worm wheels 12. In the embodiment shown by way of example, these worm-carrying shafts 13 are coaxial to each other and at their confronting ends are supported in a common bearing 14. To save space, the worm wheels 12 may be axially offset from each other; in that case the worm-carrying shafts 13 may be parallel to each other and extend to the same side of the apparatus so that the operation will be facilitated.

The use of worm gear trains rather than other positioning drives for adjusting the suction inserts 2 affords the advantage that there is no need for additional means for locking the suction inserts in their adjusted position.

Because the suction inserts are adjustable, narrower suction slots 4 can be used so that it will be sufficient for the suction blowers connected to the suction inserts to produce a suction flow at a much lower rate; and this will not adversely affect the product obtained by the spinning operation. In some cases, the force actions which can be exerted can be selected so that the spinning operations will be performed with improved results because the suction slots 4 can be positioned very close to the line at which a given yarn is being formed.

As the suction slots can be moved close to the line at which a given yarn is formed, it will be sufficient to provide suction slots 4 having a width which is not in excess of 10 to 15 times the diameter of the thickest yarn to be made on the apparatus. Under certain conditions, that width can be reduced further but should be at least 5 times the yarn diameter.

What is claimed is:

1. In apparatus for making a yarn, comprising two air-permeable, juxtaposed, closely spaced apart suction drums, which have parallel axes and define between them a generally triangular space and are mounted for rotation about said axes, and two suction inserts, each of which is contained in one of said suction drums and has a suction slot, which extends generally along said axes and faces said generally triangular space, each of said suction drums being mounted to be rotatable about its axis relative to the associated suction insert, the improvement residing in that each of said suction inserts is mounted to be rotatable about the axis of the associated suction drum for an adjustment of said suction slot relative to said generally triangular space, positioning drive means are provided for rotating said suction inserts in mutually opposite senses about the axes of the respective suction drums, and said positioning drive means comprise two stub shafts, each of which is secured to one of said suction inserts and protrudes coaxially from the associated suction drum, two worm gears, each of which is secured to one of said stub shafts, and two worm-carrying shafts, each of which is in mesh with one of said worm gears.

2. The improvement set forth in claim 1 as applied to such apparatus comprising a stationary frame, wherein said suction inserts are rotatably mounted in a frame and each of said suction drums is rotatably mounted on one of said suction inserts.

* * * * *